US008051924B2

(12) United States Patent
Drenth

(10) Patent No.: US 8,051,924 B2
(45) Date of Patent: Nov. 8, 2011

(54) METHODS OF BRAKING CORE BARREL ASSEMBLIES

(75) Inventor: Christopher L. Drenth, Draper, UT (US)

(73) Assignee: Longyear TM, Inc., South Jordan, UT (US)

( * ) Notice: Subject to any disclaimer, the term of this patent is extended or adjusted under 35 U.S.C. 154(b) by 0 days.

(21) Appl. No.: 13/094,674

(22) Filed: Apr. 26, 2011

(65) Prior Publication Data

US 2011/0198127 A1 Aug. 18, 2011

Related U.S. Application Data

(62) Division of application No. 12/427,586, filed on Apr. 21, 2009, now Pat. No. 7,967,085.

(60) Provisional application No. 61/047,029, filed on Apr. 22, 2008.

(51) Int. Cl.
*E21B 7/00* (2006.01)
*E21B 49/02* (2006.01)

(52) U.S. Cl. ..... 175/57; 166/58; 166/246; 166/249

(58) Field of Classification Search ..... 175/57, 175/58, 230, 236, 246, 249
See application file for complete search history.

(56) References Cited

U.S. PATENT DOCUMENTS

| | | | | |
|---|---|---|---|---|
| 2,510,865 | A | | 6/1950 | Cooper |
| 2,829,868 | A | | 4/1958 | Pickard et al. |
| 3,092,191 | A | | 6/1963 | Mod et al. |
| 3,103,981 | A | | 9/1963 | Harper |
| 3,115,188 | A | | 12/1963 | Cochran et al. |
| 3,126,064 | A | | 3/1964 | Miller |
| 3,225,845 | A | | 12/1965 | Koontz et al. |
| 3,346,059 | A | | 10/1967 | Svendsen |
| 3,363,705 | A | | 1/1968 | Jensen |
| 3,461,981 | A | | 8/1969 | Casper et al. |
| 3,494,418 | A | | 2/1970 | Young |
| 3,543,870 | A | | 12/1970 | Martinsen |
| 3,667,558 | A | * | 6/1972 | Lambot ..... 175/246 |

(Continued)

FOREIGN PATENT DOCUMENTS

EP 1757770 A1 2/2007

(Continued)

OTHER PUBLICATIONS

International Search Report and Written Opinion dated Oct. 28, 2009 as issued in International Application No. PCT/US2009/041435 filed Apr. 22, 2009.

(Continued)

*Primary Examiner* — Kenneth L Thompson
*Assistant Examiner* — Richard Alker
(74) *Attorney, Agent, or Firm* — Workman Nydegger

(57) ABSTRACT

A braking device for drilling operations in a borehole includes a brake retainer having a plurality of brake connector openings defined therein, a body member having a tapered surface having a first diameter and a second diameter, the second diameter being larger than the first diameter, at least one brake element positioned at least partially between the brake retainer and the body member and in communication with the tapered surface and at least one of the brake connector openings, and a bias member configured to exert a biasing force on the body member to move the body member toward the brake retainer to move the brake element from contact with the first diameter of the tapered surface toward contact with the second diameter.

20 Claims, 5 Drawing Sheets

U.S. PATENT DOCUMENTS

| | | | | |
|---|---|---|---|---|
| 3,977,482 | A | 8/1976 | Reed et al. | |
| 4,418,770 | A | 12/1983 | Lambot | |
| 4,664,204 | A | 5/1987 | Nenkov et al. | |
| 4,800,969 | A | 1/1989 | Thompson | |
| 4,823,872 | A | 4/1989 | Hopmann | |
| 4,832,138 | A | 5/1989 | Hallez | |
| 4,834,198 | A | 5/1989 | Thompson | |
| 4,930,587 | A | 6/1990 | Young et al. | |
| 5,020,612 | A | 6/1991 | Williams | |
| 5,267,620 | A | 12/1993 | Lee | |
| 5,311,950 | A | 5/1994 | Spektor | |
| 5,325,930 | A | 7/1994 | Harrison | |
| 5,662,182 | A | 9/1997 | McLeod et al. | |
| 5,785,134 | A | 7/1998 | McLeod et al. | |
| 5,799,742 | A | 9/1998 | Soinski et al. | |
| 5,934,393 | A | 8/1999 | Marshall | |
| 5,992,543 | A | 11/1999 | Soinski et al. | |
| D420,013 | S | 2/2000 | Warren et al. | |
| 6,019,181 | A | 2/2000 | Soinski et al. | |
| 6,029,758 | A | 2/2000 | Novacovicci et al. | |
| 6,039,129 | A * | 3/2000 | McLeod | 175/258 |
| 6,059,053 | A | 5/2000 | McLeod | |
| 6,089,335 | A | 7/2000 | Able | |
| 6,371,205 | B1 | 4/2002 | Langan et al. | |
| 6,425,449 | B1 | 7/2002 | Marshall | |
| 6,564,885 | B2 | 5/2003 | Attwater | |
| 6,708,784 | B1 | 3/2004 | Borg | |
| 7,296,638 | B2 | 11/2007 | Beach et al. | |
| 7,314,101 | B2 | 1/2008 | Beach | |
| 7,730,965 | B2 | 6/2010 | Jordan et al. | |
| D622,293 | S | 8/2010 | Drenth et al. | |
| D622,294 | S | 8/2010 | Drenth et al. | |
| D622,741 | S | 8/2010 | Drenth et al. | |
| D624,564 | S | 9/2010 | Drenth et al. | |
| 7,841,400 | B2 | 11/2010 | Wells et al. | |
| D632,309 | S | 2/2011 | Coyle, Jr. | |
| 7,900,716 | B2 | 3/2011 | Ibrahim et al. | |
| 7,967,085 | B2 | 6/2011 | Drenth | |
| 2004/0216927 | A1 * | 11/2004 | Beach | 175/246 |
| 2005/0034894 | A1 * | 2/2005 | Beach et al. | 175/44 |
| 2005/0241825 | A1 | 11/2005 | Burris, II et al. | |
| 2009/0032256 | A1 | 2/2009 | Sun et al. | |
| 2009/0173542 | A1 | 7/2009 | Ibrahim et al. | |
| 2009/0260882 | A1 | 10/2009 | Drenth | |
| 2009/0283328 | A1 | 11/2009 | Drivdahl et al. | |

FOREIGN PATENT DOCUMENTS

| | | | |
|---|---|---|---|
| GB | 992246 | | 5/1965 |
| WO | 03038232 | A1 | 5/2003 |
| WO | 2009108113 | A1 | 9/2009 |
| WO | 2010096860 | A1 | 9/2010 |

OTHER PUBLICATIONS

USPTO, Office Action in U.S. Appl. No. 12/427,586, dated Jan. 6, 2011, 13 pages.
USPTO, Notice of Allowance in U.S. Appl. No. 12/427,586, dated Feb. 25, 2011, 7pages.
Issue Notification dated Jun. 8, 2011 from U.S. Appl. No. 12/427,586, filed Apr. 21, 2009 (1 page).
First Action Interview Pilot Program Pre-Interview Communication dated Jul. 8, 2011 from U.S. Appl. No. 13/094,581, filed Apr. 26, 2011 (4 pages).
Notice of Allowance dated Aug. 1, 2011 from U.S. Appl. No. 29/383,554, filed Jan. 19, 2011 (10 pages).
Notice of Allowance dated Apr. 6, 2011 from U.S. Appl. No. 29/383,340, filed Jan. 14, 2011 (10 pages).
Supplemental Notice of Allowance dated Jul. 11, 2011 from U.S. Appl. No. 29/383,340, filed Jan. 14, 2011 (6 pages).
Notice of Allowance dated Apr. 6, 2011 from U.S. Appl. No. 29/383,561, filed Jan. 19, 2011 (10 pages).
Supplemental Notice of Allowance dated Jul. 11, 2011 from U.S. Appl. No. 29/383,561, filed Jan. 19, 2011 (6 pages).
Issue Notification dated Aug. 3, 2011 from U.S. Appl. No. 29/383,561, filed Jan. 19, 2011 (1 page).
Notice of Allowance dated Apr. 8, 2011 from U.S. Appl. No. 29/383,572, filed Jan. 19, 2011 (10 pages).
Issue Notification dated Jul. 27, 2011 from U.S. Appl. No. 29/383,572, filed Jan. 19, 2011 (1 page).
Notice of Allowance dated May 26, 2011 from U.S. Appl. No. 29/383,623, filed Jan. 20, 2011 (10 pages).
Notice of Allowance dated Aug. 4, 2011 from U.S. Appl. No. 29/383,623, filed Jan. 20, 2011 (10 pages).
Office Action dated Aug. 1, 2011 from U.S. Appl. No. 12/528,949, filed Aug. 27, 2009 (8 pages).
Notice of Allowance dated Aug. 25, 2011 from U.S. Appl. No. 13/094,581, filed Apr. 26, 2011 (9 pages).
Issue Notification dated Aug. 17, 2011 from U.S. Appl. No. 29/383,340, filed Jan. 29, 2010 (1 page).

* cited by examiner

METHODS OF BRAKING CORE BARREL ASSEMBLIES

CROSS-REFERENCE TO RELATED APPLICATIONS

This patent application is a divisional application of prior U.S. patent application Ser. No. 12/427,586, filed on Apr. 21, 2009, entitled "Braking Devices and Methods for Use in Drilling Operations," now U.S. Pat. No. 7,967,085 B2, which claims the benefit of U.S. Provisional Application Ser. No. 61/047,029 filed Apr. 22, 2008 and entitled "Braking Devices and Methods for Use in Drilling Operations." The contents of each of the foregoing patent applications are hereby incorporated by reference in their entirety.

BACKGROUND OF THE INVENTION

1. The Field of the Invention

This application relates generally to drilling methods and devices used in drilling. In particular, this application relates to methods and apparatus for reducing unintended egress of drilling tools from a borehole during a drilling operation.

2. The Relevant Technology

Many drilling processes are currently known and used. One type of drilling process, exploration drilling, often includes retrieving a sample of a desired material from a formation. In a conventional process used in exploration drilling, an open-faced drill bit is attached to the bottom or leading edge of a core barrel for retrieving the desired sample. The core barrel includes an outer portion attached to the drill string and an inner portion that collects the sample. The drill string is a series of connected drill rods that are assembled section by section as the core barrel moves deeper into the formation. The core barrel is rotated and/or pushed into the desired formation to obtain a sample of the desired material (often called a core sample). Once the core sample is obtained, the inner portion containing the core sample is retrieved by removing (or tripping out) the entire drill string out of the hole that has been drilled (the borehole). Each section of the drill rod must be sequentially removed from the borehole. The core sample can then be removed from the core barrel.

In a wireline exploration drilling process, the core barrel assembly (or other drilling tool) is positioned on a drill string and advanced into the formation. The core barrel assembly includes an outer portion and an inner tube assembly positioned within the outer portion. The outer portion of the core barrel again is often tipped with a drill bit and is advanced into the formation. However, the inner tube assembly of the core barrel often does not contain a drill bit and is not connected to a drill string. Instead, the inner tube assembly is releasably locked to the outer portion and the entire core barrel assembly is advanced together. When the core sample is obtained, the inner tube assembly is unlocked from the outer portion and is retrieved using a retrieval system. The core sample is then removed and the inner tube assembly placed back into the outer portion using the retrieval system. Thus, the wireline system reduces the time needed to trip drill rods of a drill string in and out when obtaining a core sample because the wireline system is used instead.

In some drilling processes, a horizontal or above horizontal borehole is drilled in an upward direction. In such processes using a wireline system, the inner tube assembly is pumped into place using a valve and seal portion on the core barrel assembly by applying hydraulic pressure behind the seal portion, thereby forcing the inner tube assembly into the upwardly oriented borehole. Once the inner tube assembly is in position and locked to the outer portion, the hydraulic pressure is removed and the core barrel assembly advanced. To retrieve the inner tube assembly, a wireline may be pumped into the borehole in a similar process, and the inner tube assembly uncoupled and removed as described above.

While such a process can reduce the time associated with retrieving core samples, difficulties can arise in removing the inner tube assembly. For example, occasionally the inner tube assembly can fall out of the drill string, causing potential hazards to equipment and personnel at the surface as the core barrel assembly exits the borehole at potentially a high velocity.

BRIEF SUMMARY OF THE INVENTION

A braking device for drilling operations in a borehole includes a brake retainer having a plurality of brake connector openings defined therein, a body member having a tapered surface having a first diameter and a second diameter, the second diameter being larger than the first diameter, at least one brake element positioned at least partially between the brake retainer and the body member and in communication with the tapered surface and at least one of the brake connector openings, and a bias member configured to exert a biasing force on the body member to move the body member toward the brake retainer to move the brake element from contact with the first diameter of the tapered surface toward contact with the second diameter.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

Figure 1:
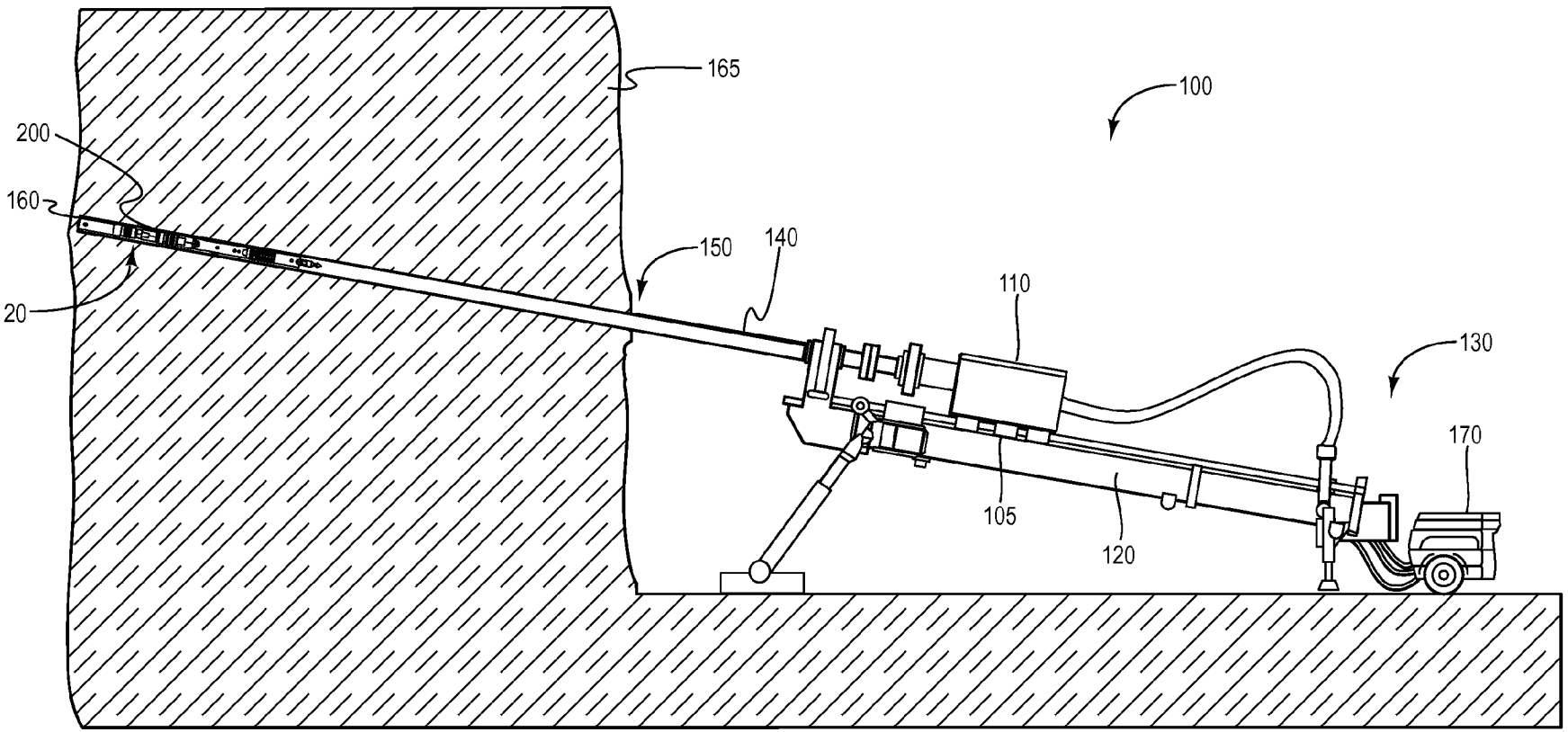
FIG. 1 illustrates a drilling system with a braking device according to one example.

Together with the following description, the Figures demonstrate and explain the principles of the braking devices and methods for using the braking devices in drilling processes. In the Figures, the thickness and configuration of components may be exaggerated for clarity. The same reference numerals in different Figures represent similar, though necessarily identical, components.

DETAILED DESCRIPTION OF THE PREFERRED EMBODIMENTS

Devices, assemblies, systems, and methods are provided herein that include a braking device and methods for controlling movement of a drilling assembly, such as a core barrel assembly, at a desired location during horizontal and/or up-hole drilling. The braking device can be incorporated in a drilling system as desired. In at least one example, a braking device is part of an in-hole assembly, such as a wireline system in general and can be part of a core barrel system in particular. In one example, the braking device can be part of a head assembly that can be moved into position relative to an outer casing. In other examples, the braking device can be coupled to or be part of the core barrel.

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on using a braking device in exploratory drilling operations, the apparatus and associated methods could be used in many different processes where devices and tools are inserted into a hole or tubular member, such as well testing, oil and gas drilling operations, pipe cleaning, etc.

FIG. 1 illustrates a drilling system 100 that includes a sled assembly 105 and a drill head 110. The sled assembly 105 can be coupled to a slide frame 120 as part of a drill rig 130. The drill head 110 is configured to have one or more threaded member(s) 140 coupled thereto. Threaded members can include, without limitation, drill rods and casings. For ease of reference, the tubular threaded member 140 will be described as drill rod. The drill rod 140 can in turn be coupled to additional drill rods to form a drill string 150. In turn, the drill string 150 can be coupled to a core barrel assembly having a drill bit 160 or other in-hole tool configured to interface with the material to be drilled, such as a formation 165.

In the illustrated example, the slide frame 120 can be oriented such that the drill string 150 is generally horizontal or oriented upwardly relative to the horizontal. Further, the drill head 110 is configured to rotate the drill string 150 during a drilling process. In particular, the drill head 110 may vary the speed at which the drill head 110 rotates as well as the direction. The rotational rate of the drill head and/or the torque the drill head 110 transmits to the drill string 150 may be selected as desired according to the drilling process.

The sled assembly 105 can be configured to translate relative to the slide frame 120 to apply an axial force to the drill head 110 to urge the drill bit 160 into the formation 165 as the drill head 110 rotates. In the illustrated example, the drilling system 100 includes a drive assembly 170 that is configured to move the sled assembly 105 relative to the slide frame 120 to apply the axial force to the drill bit 160 as described above. As will be discussed in more detail below, the drill head 110 can be configured in a number of ways to suit various drilling conditions.

The drilling system 100 further includes an in-hole assembly 20 having a braking device 200. The braking device 200 is configured to help prevent unintended expulsion of drilling tools and devices from a borehole in the formation 165. A locking or positioning assembly of a retrieval mechanism (such as a wireline spear point, cable connection, a vacuum pump-in seal, etc.) may be coupled to the proximal end of the braking device so that the braking device is between the drilling assembly and the withdrawal member. In other examples, the braking device 200 can be integrally formed with the retrieval mechanism. In the example described below, the braking device 200 includes brake elements configured to selectively engage an inner surface of an outer casing or an inner surface of a bore-hole wall.

A biasing member (such as a spring) maintains brake elements in contact with a tapered surface and the inner wall so that some friction can exist at all times if desired. In this arrangement, the friction of the braking elements increases as the tapered surface is pushed into increasing engagement with the braking elements. Thus, as a force is applied on the drilling assembly in the direction out of the borehole, the tapered surface is pressed into the braking elements. The result of this action increases the friction between the braking elements and the inner wall, causing the drilling assembly to brake and, with sufficient force, stop in the borehole. Yet an opposite force applied to the withdrawal member pulls the braking elements away from the conical surface and allows the drilling tool to move and exit the borehole.

Such a braking device may be useful in both down-hole and up-hole drilling operations. In up-hole drilling operations, where the borehole is drilled at an upward angle, the assembly may be pumped into the borehole using any suitable techniques and/or components to allow a wireline retrieval system to be used. Thus, the breaking device 200 can allow wireline retrieval systems to be used in up-hole drilling operations without the danger of the assembly sliding out of the drill-string in an uncontrolled and possibly unsafe manner. Accordingly, the braking device 200 resists unintended removal or expulsion of the drilling assembly from the borehole by engaging braking elements in a frictional arrangement between an inner wall of the casing or drill string (or borehole).

Figure 2A:
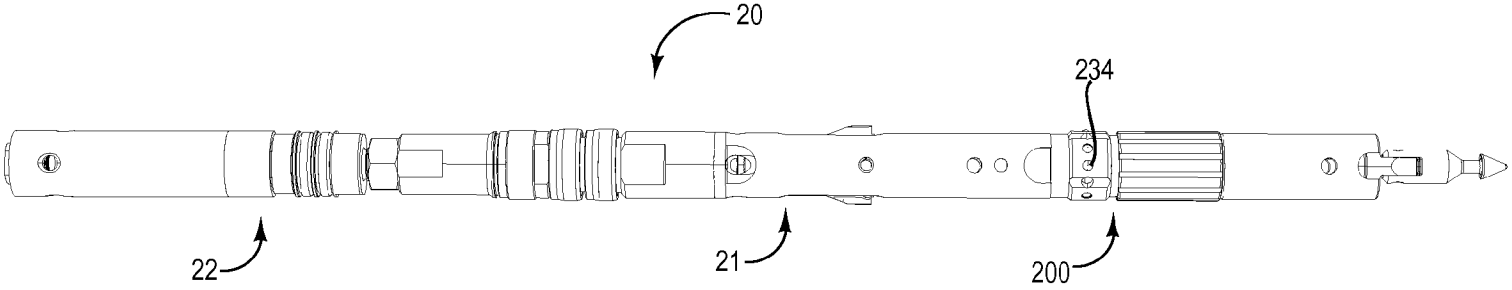
FIG. 2A illustrates an assembled view of a drilling assembly according to one example.

FIG. 2A illustrates an in-hole drilling tool assembly 20, such as an inner tube assembly, that includes a braking device 200. The braking device 200 can be coupled to a positioning mechanism, such as a latch assembly 21 that is configured to selectively engage an outer casing and/or a bore-hole wall. A drilling apparatus, such as an inner tube 22 can be coupled to the bit end of the latch assembly 21. It will be appreciated that in some examples the latch assembly 21 can be integrated with the braking device 200.

Figure 2B:
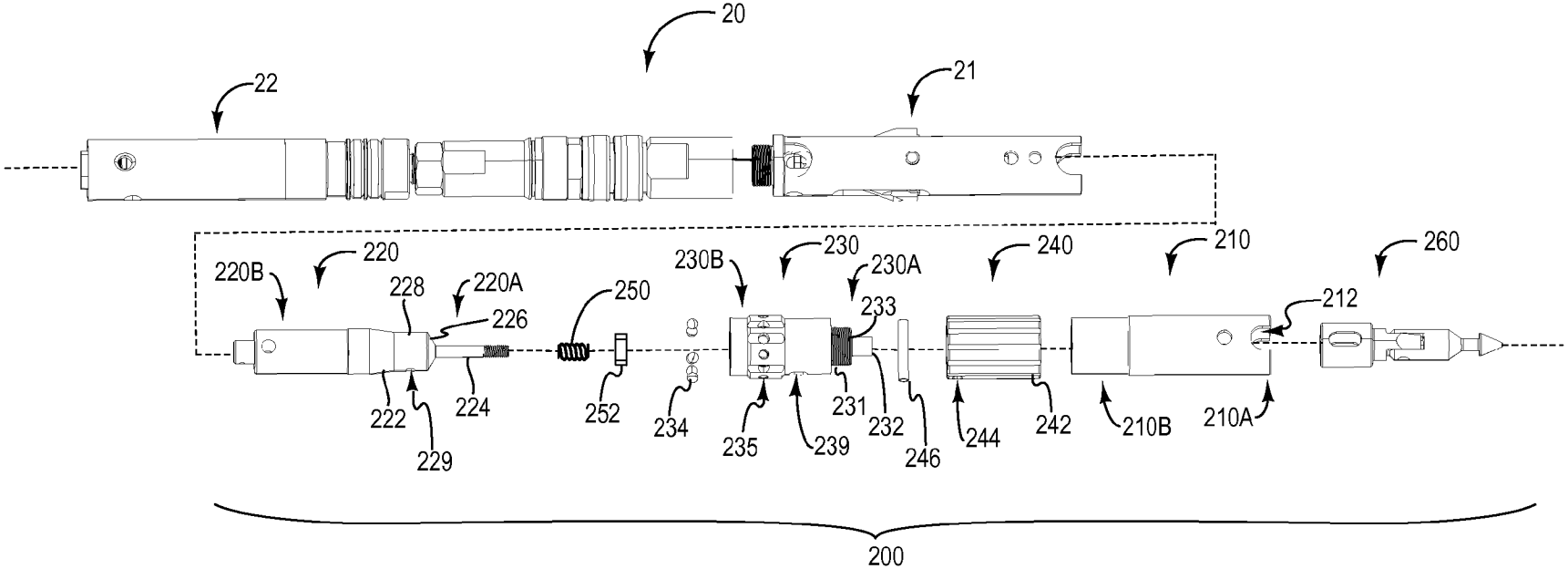
FIG. 2B illustrates an exploded view of the drilling assembly of FIG. 2A according to one example.

FIG. 2B is an exploded view of the in-hole assembly 20 illustrated in FIG. 2A. As illustrated in FIG. 2B, the braking device 200 may include a first member 210, a second member 220 (referred to herein as a body member or inner member), a brake retainer 230, a sleeve 240, a bias member 250, and retrieval member 260. Movement of the second member 220 relative to the brake retainer 230 causes features on the second member 220 to move the brake elements 234 radially inward and outward to thereby disengage and engage the braking device 200. The sleeve 240 can provide a gripping surface to manually lock the braking device 200 in a predeployed, disengaged state. The bias member 250 urges the second member 220 toward the brake retainer 230 to thereby move the braking device 200 toward an engaged state. Subsequent forces acting to move the second member 220 away from the brake retainer 230 will thereby overcome forces exerted by the biasing member 250 to thereby move the braking device 200 to disengaged state.

The braking device 200 may be a section of a larger drilling tool or drilling assembly such as a core barrel assembly, slough removal assembly, or any other drilling tool for use in a bore hole, including a drill string or a casing string. For ease of reference, the terms proximal and distal will be used to describe the relative positions of various components relative to a drill head. Accordingly, a proximal portion of a component will be described as being relatively closer to the drill head than a distal portion of the same component. It will be appreciated that the in-hole assembly 20 can be oriented in other positions as desired to provide the desired function of the braking device. In the illustrated example, the first member 210 is positioned proximally of the second member 220.

Figure 2C:
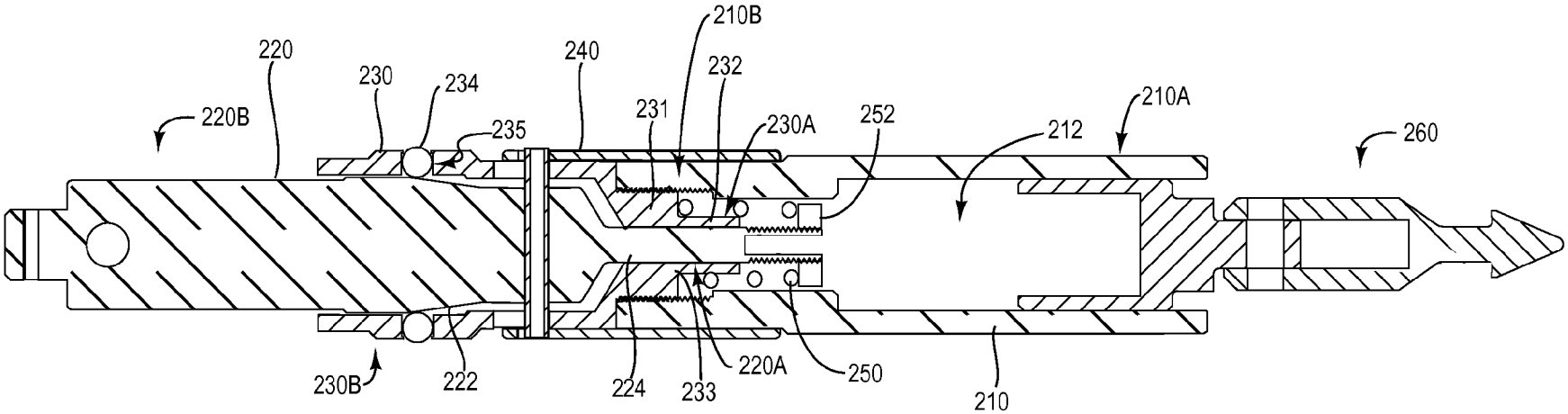
FIG. 2C illustrates a cross sectional view of the braking device of FIG. 2B.

As shown in FIG. 2C, a proximal end 210A of the first member 210 is coupled to the retrieval member 260. The first member 210 may include a channel 212 to slidingly receive at least a portion of the second member 220. The first member 210 may be coupled to the retrieval member 260 with any known connection device or method. For example, in various embodiments, the first member 210 may be coupled to the retrieval member with a pin, key, bolt or bolts, welding, threaded connection, unitary construction, etc. Similarly, the first member 210 may be coupled the to brake retainer 230 using any known connection device or method, such as a threaded connection formed on the distal end 210B and corresponding threads formed in the brake retainer 230. In other examples, the brake retainer 230 can be coupled to the distal end 210B of the first member 210 by mating holes and a spring pin retainer. In still other examples, the, first member 210 and the brake retainer 230 may form a single, integral component.

Referring again to FIG. 2B, the second member 220 includes a proximal end 220A and a distal end 220B. At least part of the second member 220 between the proximal end 220A and the distal end 220B has a tapered profile with a diameter that increases between the proximal end 220A and the distal end 220B. In the illustrated example, a tapered surface 222 is provided. The tapered surface 222 can have a generally conic profile. The proximal end 220A of the second member 220 includes a shaft 224. The shaft 224 is in communication with a shoulder 226, which is in further communication with a guide cylinder 228. The guide cylinder 228 is in communication with the conical surface 222.

The brake retainer 230 includes a proximal end 230A and a distal end 230B. The proximal end 230A can include a threaded portion 231 and a shaft 232 extending proximally from the threaded portion 231. A shoulder 233 is formed at the transition between the shaft 232 and the threaded portion 231.

As illustrated in FIG. 2C, the brake retainer 230 is configured to position the brake elements 234 relative to the conical surface 222. In the illustrated example, the brake retainer 230 includes brake connectors 235 (also shown in FIG. 2B) defined therein. The brake connectors 235 are configured to at least partially receive the brake elements 234 in such a manner that engagement between various portions of the conical surface 222 moves the brake elements 234 radially. The radial movement of the brake elements 234 through engagement with the conical surfaces 222 moves the braking device 200 between an engaged and disengaged state.

Accordingly, the brake connectors 235 (FIG. 2B) maintain the brake elements 234 in a desired configuration around brake retainer 230 in relation to the conical surface 222. All of the brake connectors 235, however, need not contain a brake element 234, depending on the braking force desired for a particular operation. For example, the brake connectors 235 not occupied by a brake element 234 may allow fluid flow into the channel 212 of first member 210. As will be appreciated in light of the disclosure provided herein, the number of brake elements can be selected as desired.

The bias member 250 is configured to exert a biasing force to urge the second member 220 in a desired direction relative to the brake retainer 230. In the illustrated example, the bias member 250 exerts a biasing force to move the second member 220 toward the brake retainer 230. While one example will be described, it will be appreciated that a bias member can be positioned at any location to exert a biasing force in any desired direction to move the tapered surface into selective contact with the brake elements.

In FIG. 2C, the bias member 250 is positioned on the shaft 224 on the proximal end 220A of the second member 220. In particular, the shaft 224 can be passed through the brake retainer 230 and through the threaded portion 231 and the shaft 232 on the proximal end 230A of the brake retainer 230. Accordingly, the shaft 224 of the second member 220 can extend proximally of the shaft 232 of the brake retainer 230. The bias member 250 can then be positioned over the shaft 232.

A fastener 252, such as a threaded nut, can then be secured to the shaft 224 to thereby position the bias member 250 between the shoulder 233 on the brake retainer 230 and the fastener 252 on the shaft. Such a configuration causes the bias member 250 to move the second member 220 toward the brake retainer 230. As the bias member 250 moves toward the second member 220 as shown in FIG. 2C, the brake elements 234 are in contact with a portion of the conical surface 222 that has a sufficiently large diameter to cause the brake elements 234 to extend through the brake connectors 235. Extension of the brake elements 234 through the brake connectors 235 allows the brake elements 234 to engage an inner surface of a casing or borehole wall. Accordingly, relative movement between the second member 220 and the brake retainer 230 causes varying portions of the conical surface 222 to engage the brake elements 234 to thereby move the braking device 200 between engaged and disengaged states.

The fastener 252 may be moved to adjust the biased position of the brake elements 234 on the conical surface 222, depending on braking requirements and small variations in the diameter of an outer tube, rod, or the like. Such adjustments to the fastener 252 allow modification to the static braking force applied when braking device is placed into any known casing.

Contact between the shoulder 226 on the proximal end 220A of the second member 220 constrains proximal movement of the second member 220 relative to the brake retainer 230 while engagement between the fastener 252 and the shaft 232 constrains distal movement. Engagement between the guide cylinder 228 and the brake retainer 230 can help provide lateral stability between the second member 220 and the brake retainer 230. One exemplary method of deploying the braking device 200 will now be discussed in more detail with reference to FIGS. 3A-3B.

Figure 3A:
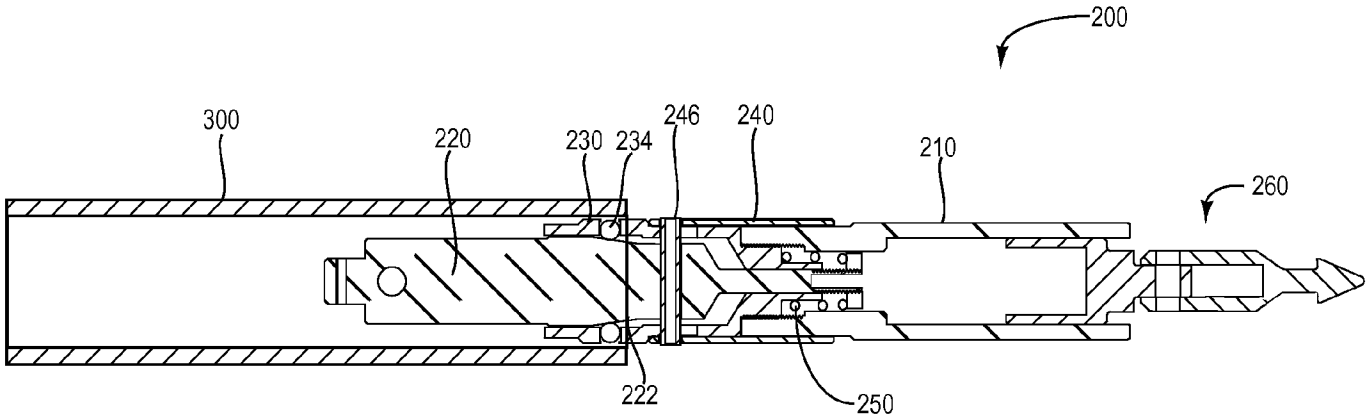
FIG. 3A-3B illustrate operation of a braking device in a casing according to one example.

FIG. 3A illustrates the braking device 200 during an initial placement step. As illustrated in FIG. 3A, the sleeve 240 may be used with braking device 200 to aid in placement of braking device 200 in the desired location of an outer portion 300. As illustrated in FIG. 3A, the braking device 200 can be biased in a disengaged configuration with brake elements 234 within the brake retainer 230. As a result, the sleeve 240 can be used during the initial placement of the braking device 200 into outer portion 300. For example, sleeve 240 may be manually employed by pulling second member 220 away from brake retainer 230, thereby moving brake elements 234 toward engagement with the smaller diameter portion of conical surface 222 and allowing brake elements 234 to retract into brake retainer 230. Sleeve 240 has a slot 244 defined therein A similar slot 229 (FIG. 2B) can be defined in the second member 220 (FIG. 2B) while a slightly larger slot 239 can be defined in the brake retainer 230. In such a configuration, the slots 229, 239 and 244 can be aligned to allow the sleeve 240 to draw the second member 220 away from the brake retainer 230. In some instances a pin 246 can then be used to manually move the braking device 200 toward a disengaged position. In particular, the pin 246 can pass through slots 229, 239, 244 (FIG. 2B). Such a configuration transfers movement of the sleeve 240 to the pin 246 and from the pin to the second member 220 as the pin 246 moves within slot 239. Accordingly, the sleeve 240 can be moved distally by gripping the first member 210 and the sleeve 240 and moving the sleeve 240 to the position illustrated in FIG. 3A to move the braking device 200 toward a disengaged position. While the braking device 200 is disengaged, it can be positioned in the outer portion 300. Thereafter, the sleeve 240 can be released causing the braking device 200 to engage the outer portion 300, as shown in FIG. 3B.

Figure 3B:
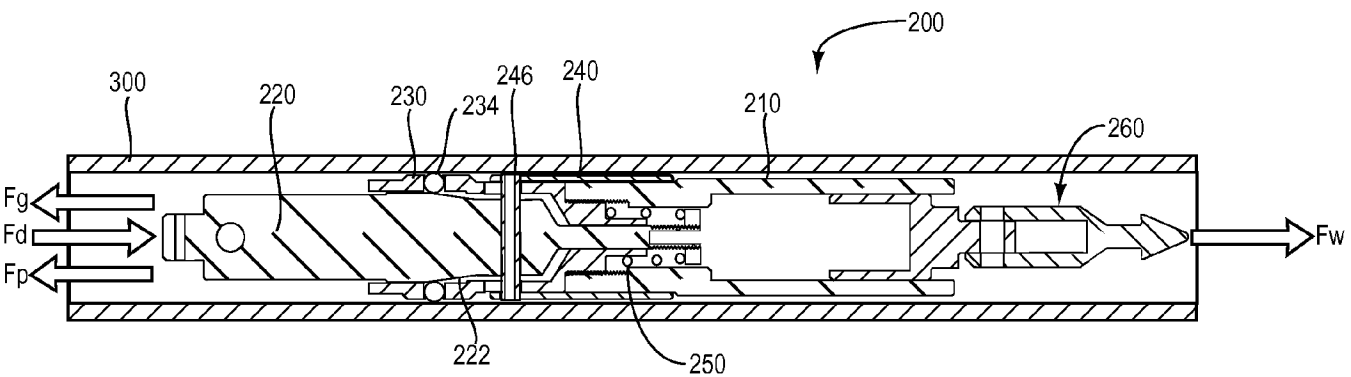

FIG. 3B illustrates the braking device 200 being used in combination with the outer portion 300 and will be used to described the operation and function of the braking device 200. As shown in FIG. 3B, the braking device 200 may be located in outer portion 300 and connected to any of the drilling tools described above or any other drilling tools. The bias member 250 biases brake retainer 230 and second member 220 together, causing brake elements 234 into engagement with the larger diameter portion of conical surface 222. The result of this action forces the brake elements 234 to extend from the outer surface of the brake retainer 230 and against the inner surface of outer portion 300 (or, in some embodiments, an inner surface of a borehole).

The force of the bias member 250 may be such that brake elements 234 are maintained in no, partial, or complete contact with both conical surface 222 and the inner surface of outer portion 300. When in no or partial contact, the braking device 200 is allowed to travel axially within the outer portion 300. When in complete contact, the braking device 200 is stopped from traveling axially, thereby also stopping the movement of the tool which it is part of or to which it is attached.

The braking device 200 is often not engaged when it is first placed in a borehole. In a down-hole placement, the weight of the assembly attached to the distal end of braking device 200, illustrated as force Fg acting on the second member 220, causes second member 220 and first member 210 to be pulled apart, disengaging braking device 200. In an up-hole (or pressurized down-hole) placement, as shown in FIG. 1, a pump-in seal may be included in the assembly attached to a distal end of braking device 200 that the pump-in seal is positioned distally from the second member 220. The pump-in seal creates a seal between the attached assembly and the borehole.

Pressurized fluid directed distally in the hole is incident on the braking device 200. This fluid flows past the braking device 200 via ridges 242 (FIG. 2B) in the sleeve 240, and against the pump-in seal described above. The force of the pressurized fluid against the pump-in seal, illustrated as Fp acting on the second member 220, exerts a distally directed force on the pump-in seal, which also acts to draw the second member 220 distally as well. This distally directed force draws the second member 220 away from the brake retainer 230 to thereby disengage the braking device 200 while an opposite axial force, acts in the opposite direction. In up-hole operations gravitational forces acting in the same direction as Fw also acts to draw the first portion 210 and the brake retainer 230 away from the second portion 220.

When engaged, the braking device 200 can prevent or slow the proximal movement of an attached drilling tool within outer portion 300. The braking device 200 can be engaged when a force generally labeled as Fd is applied in a proximal direction to second member 220. Such a force causes the second member 220, and thereby conical surface 222, to press into the brake retainer 230. This action, in turn, causes the brake elements 234 to be compressed between the conical surface 222 and the inner surface of outer portion 300, causing friction between the brake elements 234 and that inner surface. As the force increases, the friction of the brake elements 234 increases and consequently the braking force increases against that inner surface as the diameter of the portion of the conical surface 222 engaging the brake elements 234 increases. Slowing and/or stopping the proximal movement of the braking device 200 within the outer portion 300. The force Fd may be caused by the weight of a drilling assembly in an up-hole operation or by pressure of fluids/gasses underground or at a distal end of the outer portion 300 in a down-hole operation.

The braking device 200 may be removed from the outer portion 300 (or other tubular member in which it is located) at any time by any suitable removal processes. For example, when an outward (or proximal) force, labeled as Fw is applied to the retrieval member 260 to remove the braking device 200 from outer portion 300, the first member 210 is pulled away from second member 220 and relieves the compressive force on brake elements 234. The result of this action permits brake elements 234 to travel to engagement with a smaller diameter portion of the conical surface 222, releasing the braking device 200 and allowing it to be withdrawn from the outer portion 300.

Accordingly, an outward force applied to the retrieval member 260 disengages the braking device 200 and allows withdrawal of the braking device 200 (and any attached devices, such as the drilling assembly) from the outer portion 300.

In some embodiments, the braking device 200 may have other uses. For example, the braking device 200 may be used as a plug in a drill rod string, or any conduit, having pressure at a distal location. Braking device 200 automatically engages due to any difference in distal and proximal pressures sufficient to press second member 220 into brake retainer 230. In another example, the braking device 200 can be used to explore for a broken portion of a drill rod string or conduit by inserting under pressure until prevented by deformed members or by pressure loss.

Any components or devices can be provided to allow linear movement of the second member 220 with respect to the brake retainer while maintaining a coupled relationship. The brake elements 234 may have a shape substantially matching the shape of the brake connectors 235 in the brake retainer 230. For example, the brake elements 234 may be substantially spherical in shape corresponding to a round shape of the brake connectors 235. In other examples, the brake elements 234 may be flat, may have a cylindrical shape, or may have a wedge shape, to increase the braking surface area of the brake elements 234 against a casing and/or a conical surface. In other embodiments, the brake elements 234 may be of any shape and design desired to accomplish any desired braking characteristics.

The brake elements 234 may be made of any material suitable for being used as a compressive friction braking element. For example, the brake elements 234 may be made of steel, or other iron alloys, titanium and titanium alloys, compounds using aramid fibers, lubrication impregnated nylons or plastics, or combinations thereof. The material used for any brake elements can be the same or different than any other brake element.

The retrieval member 260 may be any tool or apparatus that can be used with any connection or retrieval system or mechanism known in the art. In some embodiments, the retrieval members may comprise a spear point that can be connected to a wireline system, as shown above. In other embodiments, retrieval member 260 may be coupled to a cable using a clevis or other cable attachment devices. In yet other embodiments, retrieval member 260 may be a connector for coupling to a rigid pipe.

Figure 4:
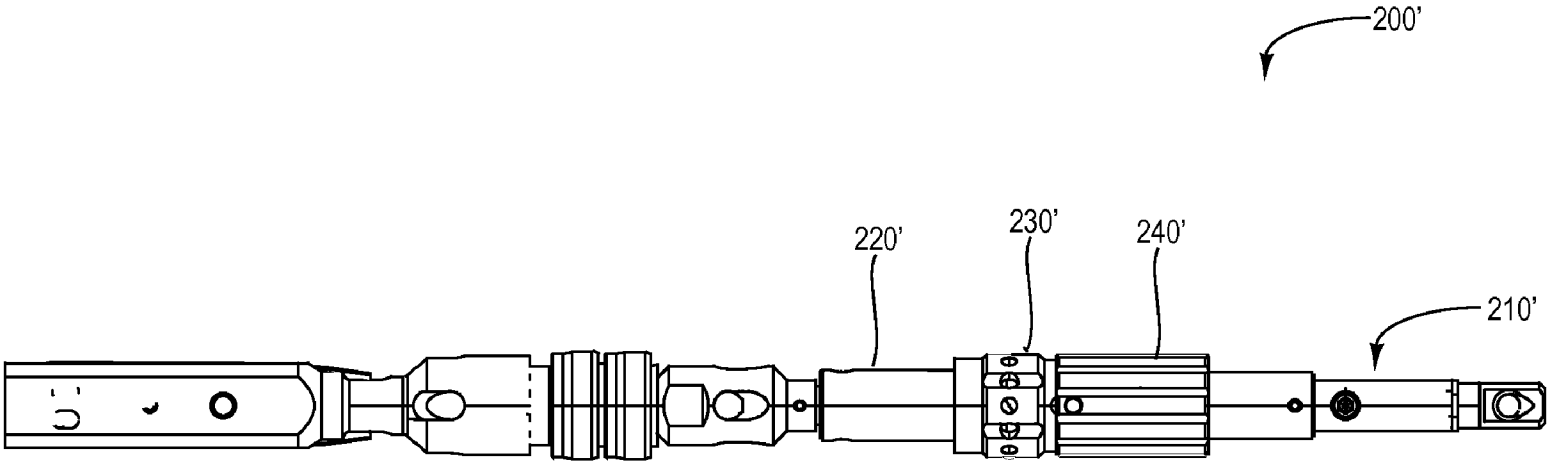
FIG. 4 illustrates a braking device according to one example.

While one configuration is illustrated in FIGS. 2A-3B, it will be appreciated that a first member can be configured in any desired manner or omitted entirely. In at least one example shown in FIG. 4, a first member 210' of a braking device 200 can be provided as an integrated overshot assembly. In such an example, a brake retainer 230' and/or sleeve 240' can be secured to a distal end of the integrated overshot assembly 210'. A second member 220' can be coupled to the brake retainer 230' to function as described above. Further, it will be appreciated that any configuration can be provided or that a first member can be omitted entirely and a brake retainer and second member can be coupled to any other components.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of core drilling comprising:

assembling a core barrel assembly by coupling a brake device between a retrieval member and an inner tube, the inner tube being adapted to receive a core sample;

lowering the core barrel assembly into a drill string by inserting the inner tube, then the brake device, and then the retrieval member into the borehole; and stopping the core barrel assembly within the drill string upon movement of an inner member of the brake device toward the retrieval member by forcing the at least one spherical brake element into contact with the drill string.

2. The method as recited in claim 1, wherein stopping the core barrel assembly comprises an outer surface of the inner member moving the at least one brake element radially outward, the outer surface tapering radially outward from a first end positioned toward the retrieval member to a second end positioned toward the inner tube.

3. The method as recited in claim 1, further comprising creating a seal between the core barrel assembly and the drill string.

4. The method as recited in claim 3, further comprising pumping the core barrel assembly along the drill string.

5. The method as recited in claim 1, further comprising causing a core sample to enter the inner tube.

6. The method as recited in claim 5, further comprising retrieving the core barrel assembly from the drill string using a wireline.

7. The method as recited in claim 2, further comprising biasing the inner member toward the retrieval member to maintain the at least one brake member against the drill string as the core barrel assembly travels within the drill string.

8. The method as recited in claim 7, wherein the at least one brake member comprises a ball.

9. The method as recited in claim 1, further comprising latching the core barrel assembly to the drill string.

10. A method of braking a core barrel assembly relative to a drill string, comprising:

positioning a braking device of the core barrel assembly into a disengaged configuration by moving a sleeve in a first direction relative to a brake retainer causing at least a portion of the brake retainer to move out of the sleeve and thereby causing a plurality of brake elements to retract into the brake retainer;

inserting the core barrel assembly into the drill string;

stopping the core barrel assembly within the drill string upon movement of the sleeve in a second direction relative to the brake retainer by causing the plurality of brake elements to move outward into contact with the drill string.

11. The method as recited in claim 10, wherein moving the sleeve in the first direction relative to the brake retainer causes an inner member with a tapered outer surface to move relative to the brake retainer thereby moving the plurality of brake elements along the tapered outer surface radially inward.

12. The method as recited in claim 11, wherein moving the sleeve in the first direction relative to the brake retainer causes a pin to slide within a slot formed in the brake retainer.

13. The method as recited in claim 12, wherein moving the sleeve in the first direction relative to the brake retainer comprises moving the sleeve toward the brake retainer.

14. The method as recited in claim 10, wherein movement of the sleeve in a second direction relative to the brake retainer causes the inner member to move relative to the brake retainer thereby moving the plurality of brake elements along the tapered outer surface of the inner member radially outward.

15. The method as recited in claim 10, further comprising biasing the braking device into the disengaged configuration.

16. The method as recited in claim 10, wherein the brake elements comprise balls.

17. A method of braking a drilling tool in a borehole, comprising:

providing the drilling tool with a braking device including at least one brake element, the at least one brake element being situated adjacent an inner member with an outer surface, the outer surface tapering radially outward as the outer surface extends from a first end to a second end; and inserting the drilling tool into the borehole in a manner that the second end of the inner member enters the borehole before the first end of the inner member;

wherein the braking device automatically stops the drilling tool within the borehole when a force is applied to the drilling tool in a direction towards a mouth of the borehole.

18. The method as recited in claim 17, further comprising engaging the braking device to resist unintended motion of the drilling tool out of the borehole.

19. The method as recited in claim 17, further comprising removing the drilling tool from the borehole using a wire line system.

20. The method as recited in claim 17, wherein inserting the drilling tool into the borehole includes disengaging the braking device prior to placing the drilling tool into the borehole.

* * * * *